US007908814B2

(12) United States Patent
Wilson et al.

(10) Patent No.: US 7,908,814 B2
(45) Date of Patent: Mar. 22, 2011

(54) COMPOSITE SIDING USING A SHAPE MOLDED FOAM BACKING MEMBER

(75) Inventors: Richard C. Wilson, Traverse City, MI (US); Patrick M. Culpepper, Massillon, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 681 days.

(21) Appl. No.: 11/648,266

(22) Filed: Dec. 29, 2006

(65) Prior Publication Data

US 2007/0193177 A1 Aug. 23, 2007

Related U.S. Application Data

(60) Provisional application No. 60/755,221, filed on Dec. 30, 2005.

(51) Int. Cl.
*E04D 1/00* (2006.01)

(52) U.S. Cl. ..... 52/519; 52/309.8

(58) Field of Classification Search ..... 52/302.1, 52/309.8, 518–522
See application file for complete search history.

(56) References Cited

U.S. PATENT DOCUMENTS

| | | | |
|---|---|---|---|
| 2,192,933 | A | 3/1940 | Saborsky |
| 2,264,961 | A | 12/1941 | Ward |
| 3,001,332 | A | 9/1961 | Wilder |
| 3,004,483 | A | 10/1961 | Prager |
| 3,158,960 | A | 12/1964 | Newton |
| 3,159,943 | A | 12/1964 | Sugar |
| 3,284,980 | A | 11/1966 | Dinkle |
| 3,289,371 | A | 12/1966 | Pearson et al. |
| 3,304,678 | A | 2/1967 | Morell |
| 3,308,586 | A | 3/1967 | Olson |
| 3,608,261 | A | 9/1971 | French et al. |
| 3,742,668 | A | 7/1973 | Oliver |
| 3,868,300 | A | 2/1975 | Wheeler |
| 3,887,410 | A | 6/1975 | Lindner |
| 3,941,632 | A | 3/1976 | Swedenberg et al. |
| 3,944,698 | A | 3/1976 | Dierks et al. |
| 3,993,822 | A | 11/1976 | Knauf et al. |
| 3,998,021 | A | 12/1976 | Lewis |
| 4,015,391 | A | 4/1977 | Epstein et al. |
| 4,033,802 | A | 7/1977 | Culpepper, Jr. et al. ..... 156/71 |
| 4,034,528 | A | 7/1977 | Sanders et al. |

(Continued)

FOREIGN PATENT DOCUMENTS

JP 2141484 A2 5/1990

(Continued)

OTHER PUBLICATIONS www.new-siding.com (Jul. 7, 2005 archived webpage).*

*Primary Examiner* — Jeanette E Chapman
*Assistant Examiner* — Daniel Kenny
(74) *Attorney, Agent, or Firm* — Richard M. Klein; Fay Sharpe LLP

(57) ABSTRACT

A panel for mounting on an exterior wall includes a shaped, molded backing member and a siding member attached to the backing member wherein the shape-molded backing member includes a rear face and an opposing front face. The shape-molded backing member is composed of closed cell expanded polystyrene foam, the front and rear faces having an outer surface composed of a tough smooth skin.

17 Claims, 14 Drawing Sheets

U.S. PATENT DOCUMENTS 4,065,333 A 12/1977 Lawlis et al.
4,073,997 A 2/1978 Richards et al.
4,081,939 A 4/1978 Culpepper, Jr. et al. ..... 52/535
4,096,011 A 6/1978 Sanders et al.
4,100,711 A 7/1978 Skuran
4,181,767 A 1/1980 Steinau
4,242,406 A 12/1980 El Bouhnini et al.
4,277,526 A 7/1981 Jackson
4,288,959 A 9/1981 Murdock
4,296,169 A 10/1981 Shannon
4,303,722 A 12/1981 Pilgrim
4,320,613 A 3/1982 Kaufman ..... 52/521
4,335,177 A 6/1982 Takeuchi
4,351,867 A 9/1982 Mulvey et al.
4,361,616 A 11/1982 Bomers
4,366,197 A 12/1982 Hanlon et al.
4,399,643 A 8/1983 Hafner
4,437,274 A 3/1984 Slocum et al.
4,468,909 A 9/1984 Eaton
4,477,300 A 10/1984 Pilgrim
4,504,533 A 3/1985 Altenhofer et al.
4,506,486 A 3/1985 Culpepper, Jr. et al. ..... 52/529
4,586,304 A 5/1986 Flamand
4,637,860 A 1/1987 Harper et al.
4,647,496 A 3/1987 Lehnert et al.
4,722,866 A 2/1988 Wilson et al.
4,788,808 A 12/1988 Slocum ..... 52/521
4,810,569 A 3/1989 Lehnert et al.
4,864,788 A 9/1989 Tippmann ..... 52/309.8
4,969,302 A 11/1990 Coggan et al. ..... 52/309.8
5,220,762 A 6/1993 Lehnert et al.
5,319,900 A 6/1994 Lehnert et al.
5,371,989 A 12/1994 Lehnert et al.
5,465,543 A * 11/1995 Seifert ..... 52/309.8
5,501,056 A 3/1996 Hannah et al.
5,502,940 A 4/1996 Fifield
5,598,677 A 2/1997 Rehm, III
5,601,888 A 2/1997 Fowler
5,636,489 A 6/1997 Leverrier
5,644,880 A 7/1997 Lehnert et al.
5,664,376 A 9/1997 Wilson et al. ..... 52/287.1
5,704,172 A 1/1998 Gougeon et al. ..... 52/169.11
5,704,179 A 1/1998 Lehnert et al.
5,772,846 A 6/1998 Jaffee
5,791,109 A 8/1998 Lehnert et al.
5,799,446 A 9/1998 Tamlyn
5,881,502 A 3/1999 Tamlyn
5,945,182 A 8/1999 Fowler et al.
5,960,598 A 10/1999 Tamlyn
5,981,406 A 11/1999 Randall
6,018,924 A 2/2000 Tamlyn
6,029,415 A 2/2000 Culpepper et al. ..... 52/522
6,195,952 B1 3/2001 Culpepper et al. ..... 52/522
6,223,488 B1 5/2001 Pelfrey et al.
6,263,574 B1 7/2001 Lubker, II et al.
6,276,107 B1 8/2001 Waggoner et al.
D448,865 S 10/2001 Manning
D450,138 S 11/2001 Barber
6,321,500 B1 11/2001 Manning et al. ..... 52/555
6,354,049 B1 3/2002 Bennett
6,358,585 B1 3/2002 Wolff
6,367,222 B1 4/2002 Timbrel et al.
6,418,610 B2 7/2002 Lubker, II
D471,292 S * 3/2003 Barber ..... D25/141
6,526,718 B2 3/2003 Manning et al. ..... 52/555
6,684,597 B1 2/2004 Butcher
6,971,211 B1 12/2005 Zehner ..... 52/518
6,979,189 B2 * 12/2005 Baxter et al. ..... 425/325
7,040,067 B2 5/2006 Mowery et al. ..... 52/519
7,204,062 B2 * 4/2007 Fairbanks et al. ..... 52/522
2001/0023565 A1 * 9/2001 Snider et al. ..... 52/408
2002/0029537 A1 3/2002 Manning et al.
2003/0024192 A1 2/2003 Spargur
2003/0029097 A1 2/2003 Albracht
2003/0056458 A1 3/2003 Black et al.
2004/0026021 A1 2/2004 Groh et al. ..... 156/244.12
2005/0081468 A1 4/2005 Wilson et al. ..... 52/528
2006/0005492 A1 1/2006 Yohnke et al.
2006/0037268 A1 2/2006 Mahaffey ..... 52/520
2006/0042183 A1 3/2006 Benes ..... 52/741.1
2006/0053715 A1 3/2006 Mowery
2006/0053716 A1 3/2006 Mowery et al.
2006/0053740 A1 * 3/2006 Wilson et al. ..... 52/745.09
2006/0068188 A1 3/2006 Morse et al.
2006/0075712 A1 4/2006 Gilbert et al. ..... 52/520
2007/0011976 A1 1/2007 Mowery et al. ..... 52/506.01
2007/0044402 A1 3/2007 Hess

FOREIGN PATENT DOCUMENTS

JP 04189938 6/1992
JP 5147997 A2 6/1993
JP 6008219 A2 1/1994
WO 9957392 A1 11/1999
WO 02070248 A2 9/2002
WO 02081399 A1 10/2002

* cited by examiner

COMPOSITE SIDING USING A SHAPE MOLDED FOAM BACKING MEMBER

This application claims the benefit of Provisional Patent Application Ser. No. 60/755,221 filed on Dec. 30, 2005, incorporated herein by reference in its entirety.

BACKGROUND

The present invention pertains to sidewall foam backer panels to be used as siding elements attached to elongated siding panels having a vinyl or other polymeric veneer profile for an exterior wall of a building.

The construction industry, both new construction and remodeling presents opportunities for the use of composite siding panels having a veneer of a vinyl or other suitable decorative polymeric material connected to foam insulating backers. Such materials can be generally referred to as insulated siding.

Typically, the insulated foam backer is prepared by the initial formation of the polymeric foam by placing suitable polymeric material in a suitable expander machine where precursor resin is transformed from its granular state to pellets in an expanded state. The expanded pellets are conveyed to a suitable molding machine where they are subjected to heat and steam pressure to create a block, typically 50×50×216 inches. The block is cut to a desired profile using a computer-controlled hot wire cutting machine. A suitable number of beads/lines of permanently flexible adhesive are applied to the prepared insulated foam backer and a vinyl siding product having a matching profile is adhered to the prepared foam insulation backer. To date, the most efficacious adhesive materials are hot-melt type adhesives.

The overall "block molding" method and resulting product are not without problems. It has been found that hot-wire cutting operations performed on the foam block in order to provide the desired insulated foam backer profile also relieve stresses and introduce camber into the material cut from the sides of the foam block. As used herein, the term "camber" describes the problem of the insulated foam backer material exhibiting lateral bow. This problem can arise because the block of expanded foam polymeric material has various densities and moisture gradients throughout its profile. Cutting the foam block material can release stresses resulting in the outside panels being cambered. The significance and intensity of the problem can increase depending upon the length and/or width of the foam block and the resulting composite siding product. It can be appreciated that siding products of greater length and width are desirable for ease and efficiency in installation in various construction projects. It should be noted that backers exhibiting camber frequently jam in the factory lamination equipment making it difficult to align and bond the respective materials. Backers having camber measured from side edge to side edge of more than ½ inch per piece over the length of a piece are typically scrapped.

Additionally, the surface profiling operation presents its own problems and drawbacks. The hot wire cutting equipment is limited to two (2) dimensional cutting. Heretofore, the blocks of expanded foam were formed and hot wire cut to provide the desired shape or contour. Additionally, any side or interior surface contour must be imparted by suitable processes that, many times, are implemented separate from the initial foam formation and foam backer formation process.

It can be appreciated that additional handling necessary for the formation of geometric regions and features can increase the complexity of the manufacturing process and can increase the opportunity for damage and the like. The cutting processes previously necessary to produce the contoured insulated foam backer panel can result in a backer panel having undesirable wire marks and roughed surfaces. Such rough surfaces can contribute to unsightly, irregular siding appearance, increased handling and processing, less breakage. Additionally, the roughened surface can have adverse effects on the effectiveness of adhesives and the appearance of any materials overlying the surface.

Thus, it would be desirable to provide an insulated siding construction suitable for use in outdoor applications such as homes and the like that utilizes a three (3) dimensional shape molded insulated foam backer. The EPS foam backer material is the most likely material for this use. However, other materials may be suitable to shape molding.

SUMMARY

Disclosed herein is a unique shape molded foam backer panel designed and molded to provide a superior foam backer that will support and insulate a 12½ feet siding panel. The backing member also includes a rear face and an opposed front face and is composed of closed cell expanded polymeric shape-molded foam. The front and rear faces are composed of closed polymeric cells. The backing member is configured with at least one three dimensional feature such as front face geometric features, rear face geometric features and vertically oriented side features.

DESCRIPTION OF THE DRAWINGS

The description makes reference to the accompanying drawings wherein like reference numerals refer to like reference characters throughout the several views and in which.

DESCRIPTION

Figure 1:
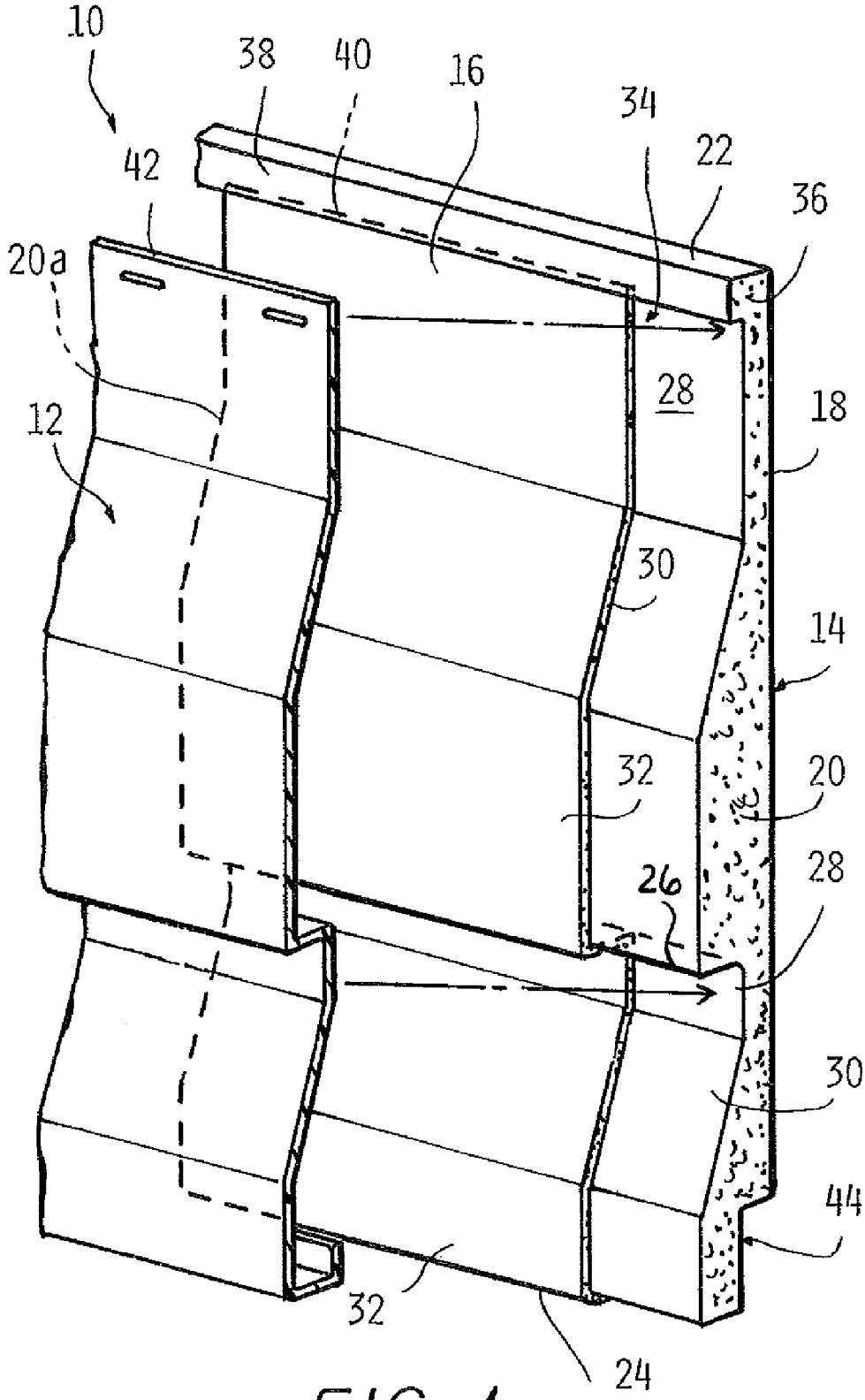
FIG. 1 is an exploded view of an insulated siding unit having a shape molded insulated foam backing member as disclosed herein.

Referring to FIGS. 1-7, disclosed herein is an insulated foam backer panel 10 having shape molded foam backing member 14 and a siding layer 12. The shape molded foam backer member 14 has a front face 16 and a rear face 18 opposed thereto. At least a portion of the front face 16 of the backer member 14 is covered by the siding layer 12. The shape molded backer member 14 will also have an opposed side face, such as side face 20 as well as top face 22 and bottom face 24. Embodiments of the insulated siding panel 10 as disclosed herein are depicted in FIG. 1.

Figure 6:
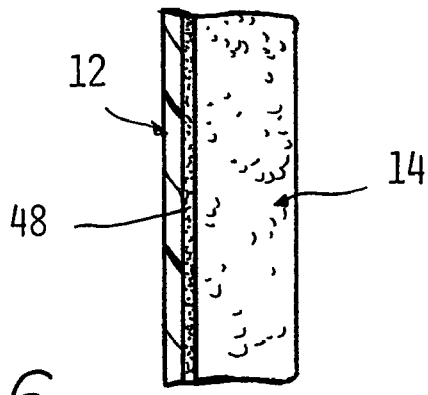
FIG. 6 is a detail cross sectional view of the insulated foam backer and the composite insulated siding panel.

The backer member 14 is composed of expanded polymeric foam with the front and rear faces 16, 18 composed of a substantial portion of closed polymeric cells. As used herein the term "substantial portion of closed polymeric cells" is taken to mean that a portion of polymeric cells that will provide a smooth surface such as that illustrated in FIG. 5. The cells proximate to the surface may be compressed or elongated as compared to cells located in the central region of the backer member 14. In contrast, other backer members typically have at least one face 16, 18 that is characterized by ruptured cells or cell structure as illustrated in FIG. 6. The typical surface of other wire cut backer members will have multiple regions of concavity imparted during the cutting process contributing to the overall roughness of the respective face. Where desired or required, at least one of the top face 22, bottom face 24 and the side face(s) 20 can possess the smooth surface characteristics present in the front and rear faces 16, 18.

It is contemplated that various cellular plastics can be employed as the material for the shape molded backing member or foam insulated backer disclosed herein. As used herein, the term(s) "cellular foam" or "cellular foam plastic" are taken to mean a plastic or polymeric material with numerous cells of trapped air distributed throughout its mass. Suitable examples of such materials can also be referred to as expanded plastics or foamed plastics with expanded polystyrene foam being but one non-limiting example.

"Expanded polystyrene foam" as used herein refers to cellular foam plastic made from polystyrene typically by incorporation of a volatile blowing agent into polystyrene beads as they are polymerized or afterward. In expanded polystyrene, beads of polystyrene are first pre-expanded and allowed to rest for a suitable interval, then molded in closed steam-heated shaped molds to produce closed-cell molded foams 19. The size and density of the closed cells 19 can vary from application to application.

As used herein, the term "shape molded backer member" is taken to mean a member formed of front and rear faces 16, 18 with surfaces characterized by a substantial portion of closed polymeric cells 19. The term "closed polymeric cells" as used herein is taken to mean intact units resulting from the expansion and foaming process. It is contemplated that these materials may be spheroid nodules having a polymeric shell with a relatively hollow central cavity. The front and rear faces 16, 18 are composed of a substantial portion of intact cells 19, i.e., cells that do not have their inner cavities exposed. Where desired or required, the shape molded backer member may have additional edges 20, top and/or bottom ends 22, 24. It is also contemplated that various contours, grooves and details can be defined in the one or more of the faces, edges or ends. These can be characterized in whole or in part by the smooth, tough surface of the front and rear faces.

The shape molded backer member 14 has a tough, durable, smooth skin on the outer surface of the front and rear faces 16, 18, as well as any ends, edges, and additional surfaces. The unique surface characteristics of the shape molded product can permit and facilitate use with siding layers having reduced veneer thickness. Without being bound to any theory, it is believed that the outer skin of the shape molded backer member underlies the thin siding layer and acts in concert with the structure of the backer member to support and conform the veneer in a smooth, aesthetically pleasing configuration. It is contemplated that the siding layer may be traditional vinyl veneer material at thickness measuring from 0.020 to 0.036". The current standard vinyl siding veneers are made to bottom/low thickness at 0.040". Various other polymeric or coating materials as would be cost effective can be used.

Thus, the term "shape molded" pertains to closed cell foam panels formed by the reaction of materials such as expanded polystyrene in a suitably configured die mold. Typically the precursor material is reacted in the presence of water and heat to expand pellets of the polymeric precursor material during the reaction process. During the process that forms the panel, the closed-cell material expands and presses against the die surface to form compressed elongated closed cells that form a characteristic tough smooth skin. The shape molded process produces a panel that is essentially straight and free of camber. It is contemplated that the shape molded panel member will be self-supporting. Without being bound to any theory, it is believed that the shape molding process can position expanded foam of varying density at specific locations throughout the shape molded panel. The variations in density can provide a tough, durable, reinforced insulated foam panel member that resists warping, bowing and handling damage. It is contemplated that the backing member 14 can be configured to provide structural integrity and support to the resulting insulated siding panel 10, through "dual" densities; and the dimensions of the backing member 14 are stable and predictable providing a superior quality.

The backing member 14 can have various three-dimensional features located on one or more of the front face 16, rear face 18, top end 22 or bottom end 24 as would be suitable for the associated insulated siding panel 10. The three-dimensional features can include but are not limited to ridges, grooves, indents, detents and the like. Such geometric features can be imparted in a single operation by the shape molding process. The backing member 14 is pigmented as desired or required. In situations where the siding layer 12 is extremely thin, it is contemplated that the insulated foam backing layer can be pigmented to complement the color of extremely thin siding layers.

The siding layer 12 as disclosed herein can be a siding product adapted to overlie at least a portion of the front face 16 of the shape molded backing member 14. The siding layer can have any suitable configuration or contour suitable for the given panel application. It is also contemplated that the siding layer 12 may have any suitable configuration desired or required to impart the aesthetic look desired. One non-limiting example of aesthetic configuration would be contours configured to mimic traditional flat faced wooden clapboard.

It is contemplated that the shape molded backing member 14 can have a suitable configuration complementary to the configuration of the siding layer 12. Suitable configurations are depicted in the various drawing figures. The degree of correspondence between the contours in the siding layer 12 and shape molded backing layer 14 can be at any degree from approximate to exact depending on various factors including but not limited to the material type and/or thickness of the siding layer 12. The shape molding process provides dimensional accuracy and consistency that is far greater than that achieved through the wire cutting process.

In the insulated siding panel 10 disclosed herein, it is contemplated that the siding layer 12 will be composed of a suitable polymeric material with vinyl materials being particularly suitable. The siding layer 12 can have any suitable thickness. While it is contemplated that siding thicknesses above 0.037 to 0.039 inches may be employed as desired or required, the shape molded backing member 14 as disclosed herein is particularly suited for use in an insulated siding panel 10 having a polymeric siding layer of a thickness below that heretofore necessary for providing structural support for the insulated siding panel 10. Polymeric materials, particularly vinyl materials are contemplated for use in the insulated siding panel 10 disclosed herein. In various embodiments, it is contemplated that the thickness of the siding layer can be below 0.040 inches. It is contemplated that, in such situations, the structural strength of the insulated foam backing layer 14 is such that the need for structural strength and integrity of the siding layer 12 is minimized.

Is contemplated the insulated siding panel 10 will have at least one ridge 26 defined in the front face of the pane and extending form one side to another. The panel 10 may also include suitable lateral indentations and planar regions can also be included in the outer face of the panel.

The siding layer 12 can be connected to the backing member 14 in a wide variety of fashions. It is contemplated that connection can occur at any time between manufacture and installation such that the siding layer 12 and backing member 14 are joined to one another in the installed or "in use" configuration. Nonlimiting examples of "connection" include insertion or "dropping in" the backing member 14 between the siding layer 12 and the wall as well as procedures such as the use of mechanical fasteners, adhesive bonding, and/or chemical bonding at any location either prior to or during installation. The methods can be mixed as desired or required.

Where adhesive materials are to be employed, the adhesive can be applied by any suitable method. The adhesive material can be applied as a bead, thin layer or the like. In certain applications, it is contemplated that the adhesive can be applied by a suitable spray applicator to provide a thin uniform adhesive coating over the tough durable skin of the backing member. The shape molded backer has a smooth surface finish that fits snuggly with the siding panel, therefore adhesive mileage is greater and adhesive quantities can be reduced while the resulting bond is stronger. Suitable materials will be continuously flexible non-latex adhesives such as thermoplastic PSAs. Non-limiting examples of suitable spray thermoplastic adhesive coating materials include DUROTAK.

As depicted in FIG. 1, the shape molded backing member 14 has a front face 16 that includes centrally positioned lateral ridge 26. The upper face can include other contours and regions as desired or required to conform to the general surface contours required in the insulated siding panel 10. The shape molded backing member 14 has a central depressed region 28 extending downward from the centrally positioned ridge 26. The depressed region is contiguously connected to an outwardly extending region 30. The outwardly extending region 30 is contiguously joined to a planar region 32. Together the centrally positioned ridge 26, the central depressed region 28, angled region 30 and the planar region 32 form a contour that mimics the contours found in a single conventional siding panel.

It is contemplated that the shape molded backing member can be configured with multiple contours to mimic multiple conventional siding panels as desired or required. In the embodiment as depicted in FIG. 1, the shape molded backing member 14 is configured to mimic two conventional siding panels. The various regions can each be characterized by the closed cell polymeric surface and by the tough smooth skin described previously. The smooth surface typically extends through each of the various planar regions, however, where desired or required, it is contemplated that one or more regions can have differing surface characteristics provided that the overall performance of the backing member is not compromised.

Figure 2:
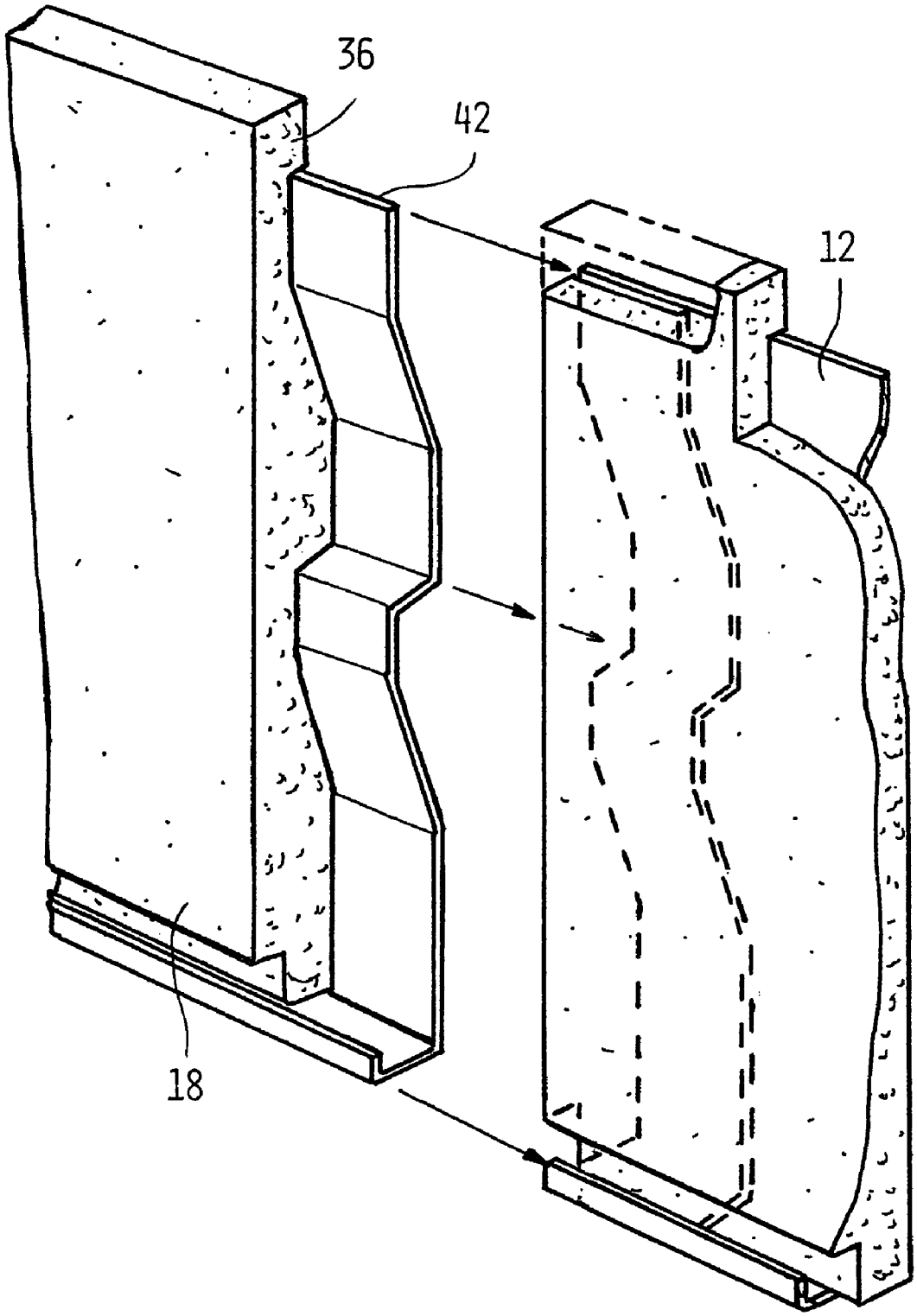
FIG. 2 is a cross-sectional detail of abutting insulated siding panels of FIG. 1.
Figure 3A:
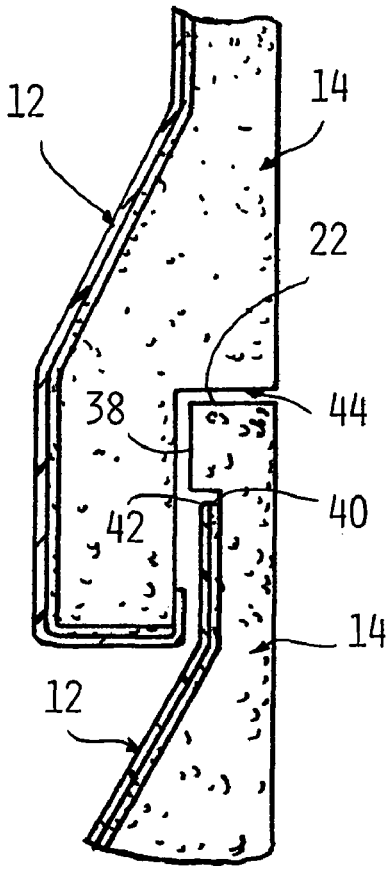
FIGS. 3A and 3B are cross-sectional views of two interlocking composite backers positioned in top to bottom abutting relationship.
Figure 3B:
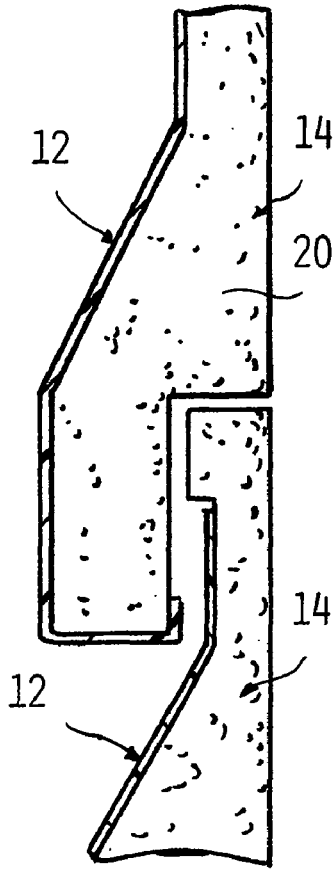
Figure 4A:
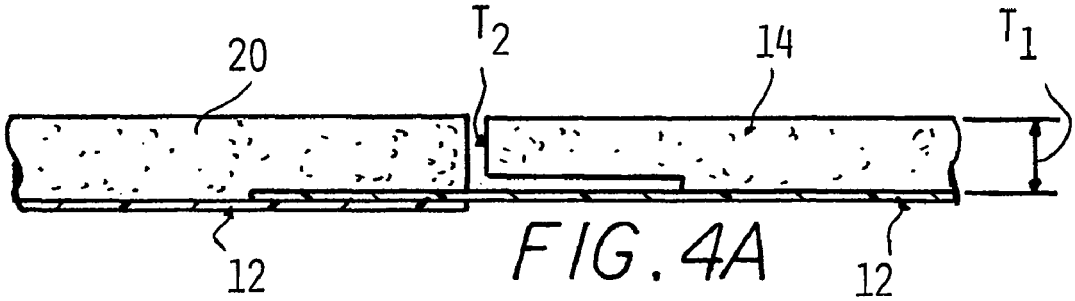
FIG. 4A is a detail cross-sectional view of two abutting side edges of insulated foam backer units. The vinyl panels show the unique new siding panel overlap and indentation feature of FIG. 1.
Figure 4B:
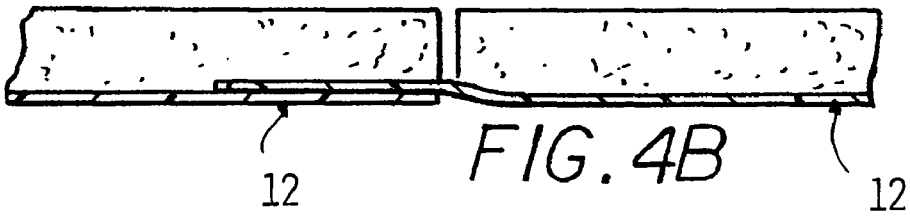
FIG. 4B is an alternate version of FIG. 4A.
Figure 7:
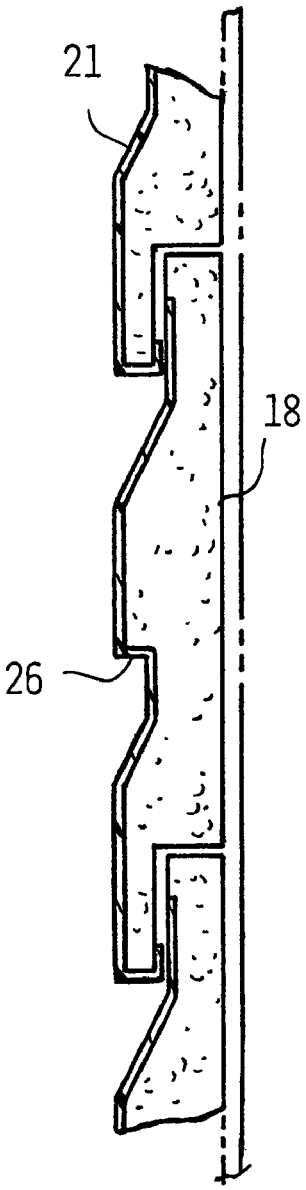
FIG. 7 is a cross-sectional of top-to-bottom abutting insulated foam backer panels with the corresponding siding panels assembled and shown mounted on a wall.
Figure 5:
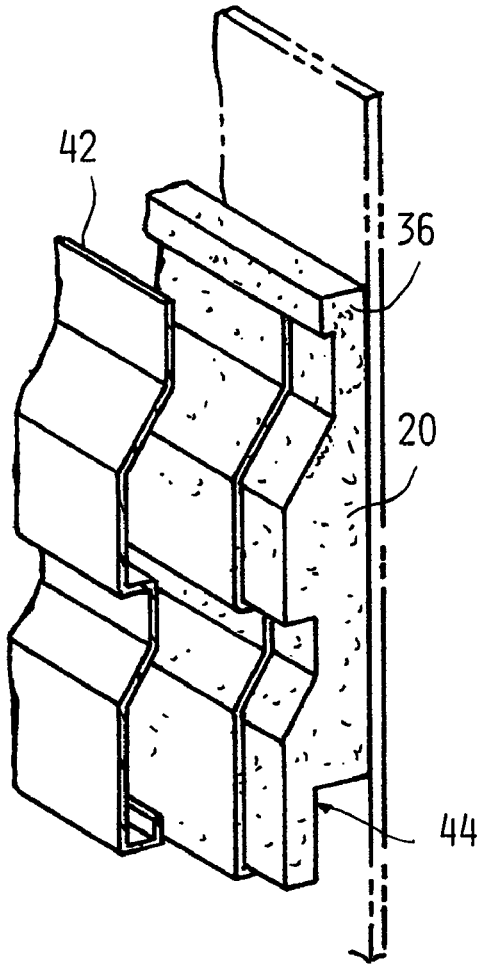
FIG. 5 is a cross-sectional view of a portion of the insulated siding panel element of FIG. 1 shown in place on a wall.

The shape molded backing member 14 can also have side regions 20 and/or top and bottom regions 22, 24 that include surfaces formed of expanded foam material. As depicted in FIG. 1, the shape molded backing member 14 is formed with a detent or pocket extending vertically along one side of the shape molded backing member 14. As depicted, the detent 34 extends vertically inward from one of the side faces 20. The detent 34 is contiguous with the outer face 16 of the shape molded backing member 14. The detent 34 has outwardly positioned surfaces that are composed substantially of closed cell polymeric foam. The surface includes the tough smooth skin found in the outer face 16. As depicted, the siding layer 12 of insulated panel 10 overlays the outer surface 16 of shape molded backing member 14. The siding layer 14 overlies the detent 34 to form a continuous pocket as depicted in FIG. 1 and 2. As depicted, the detent 34 has an offset outwardly oriented face 36 and a side wall 38 that is contiguously connected to the outer face 16 at an outer edge. The shape molded backing member 14 will have a first average thickness T1 in the central region of the backing member that is sufficient to provide suitable insulation and support qualities to the finished insulated panel 10. The shape molded backing member 14 can have a second lesser thickness T2 such that the detent 34 is configured to accommodate a projection or projections extending from an abutting insulated panel. The detent 34 provides a pocket for receiving protruding siding layer for an abutting insulated siding panel. In this manner, It is contemplated that the detent 34 will be toleranced to securely receive the abutting insulated side panel. Suitable detents can be configured in the shape molding process to impart the desired detent configuration.

The opposed side region 20*a* can be configured without the detent 34 such that the outer face 16 uniformly terminates at the side edge 20*a*. Where desired or required, the portion of the siding layer 12 proximate to the opposed side region 20*a* can project outward beyond the opposed side region 20 and be received in the channel defined by a detent 34 and overlying siding layer 12 of an adjacent insulated siding panel 10.

The side edges 20, 20*a* may have a surface characterized by closed polymeric cells. It is contemplated that the surface of edge(s) 20, 20*a* will exhibit a tough, durable, smooth skin, consistent with the surfaces of the front and rear faces. The detents can have various attributes and configurations imparted by the shape-molding process. As depicted in FIG. 2, edges 20, 20*a* can be placed in abutting or adjacent position as desired or required. The placement of and space between edge 20 relative to mating edge 20*a* will be that appropriate to prevent or minimize air infiltration. The mating configuration also serves to lessen the effect of peel away of installed insulated siding during wind and weather and provides greater continuity—both visual and structural—of the siding product in the installed configuration. The height of the detent 34 will typically be sufficient to receive the protruding portion the siding layer of the abutting or mating insulated siding panel.

It is contemplated that the surface of detent 34 will have a tough, durable, smooth skin on its outer surface essentially contiguous with that of the side face 20. The detent 34 can be configured as desired or required. Non-limiting examples of such additional geometric constructs include various tongue and groove elements to interconnect two abutting insulated siding panels as depicted in FIG. 1, it is contemplated that the detent 34 extends from the top of the shape molded backing member or from a region proximate thereto to the bottom of shape molded member or to a region proximate thereto. Thus between panel-to-panel interconnection utilizing panels with mating side configurations as depicted herein provides an extended siding construction that minimizes air infiltration and can present a visually continuous surface with minimal perceptible vertical ridges, lines and contours. This is a very desirable installation and marketing feature.

It is also contemplated that the regions proximate to side faces 20, 20*a* of shape molded backing member 12 of insulated siding panel 10 can have additional geometric configurations as desired or required. Non-limiting examples of such additional geometric constructs include various tongue and groove elements to interconnect two abutting insulated siding panels. The region proximate to the side edges 20, 20*a* can be configured with various suitable geometric features to facilitate installation, position of the insulated siding panel 10 relative to other siding panels and/or other architectural features or elements as desired or required. Non-limiting examples of such enhancements can include various mating protrusions, indentations, and the like, as desired or required. It is contemplated that such geometric enhancements may be ones that facilitate positioning of one panel relative to another during or after installation. It is also contemplated that such geometric enhancements may be ones that provide attributes such as identification, instruction, or the like, as desired or required.

It is also contemplated that the shape molded backing member 14 can have upper and lower edges 22, 24 having suitable configurations as desired or required. As depicted in FIG. 1, the upper edge 22 of shape molded backing member 14 is located proximate to upper region 36. As depicted, upper region 36 has a lip 38 that extends outward from the shape molded member 14 defining edge 40. In the insulated siding panel 10 as disclosed herein, the upper edge 40 of siding layer 12 is in abutting relationship to edge 42. The edge 40 may have any suitable depth. As depicted, it is contemplated that the depth of edge 40 will be one sufficient to permit the upper edge 42 of siding layer 12 to be seated flush with face 38 of upper region 36.

As depicted, the siding layer 12 projects beyond the front face 16 of the insulated siding panel 10 to define an opening into which a siding layer 12 of a mating insulated siding panel element can project. When installed, the respective panels are interlocked in a shiplap fashion.

Side face 38 and/or edge 40 can have surfaces composed of closed cell polymeric material. Thus side face 38 and/or edge 40 can have the tough smooth surface discussed previously.

If desired or required, the lower edge 24 can have a region proximate thereto that includes the lower portion of flat region 32 as depicted in FIG. 1. The lower region can include a lateral relief 44 defined on the inner face 18 of the shape-molded backing member 14. The lateral relief 44 is configured to overlay the region proximate to the upper edge 22 of a mating shape-molded backing member 14. It is contemplated that the surfaces defining the detent 44 can be composed of closed cell polymeric foam and may have the tough smooth skin discussed previously.

Where an elongated channel is provided as lateral relief 44, it is contemplated that the lateral relief 44 will have dimensions sufficient to accommodate expansion and minimal movement of the insulated siding panels relative to one another while maintaining imperviousness to wind penetration. The panel-over-panel configurations utilizing panels with mating top and bottom configurations as depicted herein provides siding construction that minimizes air infiltration while providing an aesthetically pleasing visually continuous surface.

It is contemplated that an end form can include other shapes and configurations as desired or required. At least a portion of the contours and configurations will be characterized by closed cell polymeric material. The contours and configurations will have a tough smooth skin surface similar to that found on the inner and outer faces of the shape molded backing member 14. While it is contemplated that at least a portion of the contours and configurations will be characterized by closed cell polymeric surfaces, it is within the purview of the present disclosure that all contours and configurations are characterized by closed cell polymeric foam surfaces.

The shape molded backing member 14 as disclosed herein is straight and free of camber. As used herein, the term "camber free" is defined as a shape-molded backing member having a camber of less than ½ inch.

Without being bound to any theory it is believed that the shape molding process provides a self-contained structure that balances internal stresses produced during the foam formation process. It can be appreciated that the shape-molded panel produced by producing expanded foam in a suitably configured die, produces a thin panel having the geometric configurations integrally included in the molded panel. The self-supporting nature of the shape molded backing member provides an insulated siding panel that is straight and free of camber. The backing member and the insulted siding panel can have lengths greater than 16 feet and thicknesses between ¼ and 12 inches. Without being bound to any theory, it is believed that the shape molded backing member resulting from the production of expanded foam material in the associated die that is durable, and can be more readily and easily aligned in the manufacturing and assembly processes of the insulated siding panel. One benefit of this is less scrap and increased production rates. Another benefit is that the backing member is capable of taking more of the structural support load of the resulting insulated siding panel.

The shape molded backing member 14 disclosed herein exhibits greater flexural strength than backer members produced by the wire cut methods. It is believed that the smooth tough polymeric skin formed during the shape molding process works in concert with the superior fusion strength derived from the molding process to provide significantly greater flexural strength. It is believed that the flexural strength of shape molded backing members as disclosed herein can be increased by as much as 20 percent over similarly configured parts prepared by wire cut methods.

To this end, flex tests are conducted on two similarly dimensioned backing members formed by either the wire cut method or by shape molding. Flex tests conducted in accordance with ASTM C203 confirms that the shape-molded backing members possess greater flexural strength in excess of 20 percent over wire cut counterparts with flexural strengths greater than 24 percent being achievable.

Shape-molded backing members such as those disclosed herein exhibit less brittleness than wire cut backer members. Shape molded backing members as disclosed herein can advantageously exhibit more resistance to many of the cracking and breakage events typically encountered during storage, handling and installation.

Shape molded backer members as disclosed herein can also exhibit greater bridging strength over wire-cut backing members. Insulated siding panels 10 utilizing shape-molded backing members 14 will typically exhibit greater capability of spanning larger gaps in the wall surface thereby leveling the exterior wall. It is also contemplated that shape molded backer members can be used in insulated siding panels utilizing reduced thickness siding elements such as those below 0.040 inches.

Surfaces of shape molded backing members typically will be free of cellular craters and linear depressions, marks, and artifacts such as those created by wire cuts. The shape molding process produces a finished part with excellent dimensional stability. Shape molded backing members will exhibit a tough smooth surface having compressed closed polymeric cells.

Thus as broadly construed, the shape molded backing member 14 has front and rear faces characterized by a substantial portion of closed polymeric cells. It is contemplated that the portion of closed polymeric cells present in the front face and the rear face will be that capable of providing a suitably continuous smooth surface. The degree of smoothness can be measured by a profilometer or any suitable measuring means that will facilitate stronger bonding with an associated siding layer.

Backing member 14 has a rear face 18 and an opposed front face 16. The rear face of the backing member 14 defines a planar surface adapted to overly a wall or suitable surface on which the insulated siding panel 10 is to be positioned.

The insulated siding element 10 also includes siding layer 12 adapted to overlay and be connected to the backing member 14. As depicted, the siding layer 12 is connected to the backing member 14 such that at least a portion of the front face 16 of the backing member 14 is covered by the siding layer.

The siding layer 12 can be connected to the backing member 14 to any suitable means. As depicted, the backing member 14 can be connected to the siding member 12 to a suitable bonding or adhesive layer 48 interposed between the two respective layers. It is contemplated that the adhesive layer is composed of a suitable material such as a polymeric adhesive compound or formula. The adhesive material is applied at a sufficient thickness to facilitate adhesion between the respective backing member 14 and siding layer 12 at predetermined or prescribed bond strength.

The adhesive layer 48 will have an outer surface opposed to the backing member 14. The inner surface of the adhesive layer contacts and conforms to the surface of the outer face 16 of the backing member 14. The adhesive or bonding layer 48 overlies and conforms to the smooth surface defined by the closed cells of the polymeric material.

The adhesive material can be any suitable composition compatible with the material employed in the backing member 14 and that employed in the siding layer 12. The material of choice will be one that maintains flexibility and strength in concert with the siding layer and backing member 14 over a wide variety of temperatures. One non-limiting example of a suitable temperature range is −20° F. to 220° F.

It is contemplated that the adhesive layer can be produced by any suitable manner or process. A non-limiting example of an adhesive layer producing process is by extrusion or spray processes. When these adhesives are employed, it is contemplated the materials will be a suitable continuously flexible adhesive. Suitable materials include thermoplastic polymeric pressure sensitive adhesive. Non-limiting examples of such materials include water based or solvent based PSAs containing acrylic, vinyl acrylic, styrene acrylic, and urethane acrylic and butyl acrylate. Peel adhesion, tack level, creep and shear resistance, viscosity, age resistance, crosslinking, hardness, and softness can be adjusted to a desired end point by selecting the appropriate additives. Suitable materials include those commercially available from National Starch under the trade name DUROTAK.

Deposition of the adhesive material can be by any suitable method with methods that reduce or eliminate telegraphing through the overlying siding layer being preferred. Thus spray deposition can be utilized as well as methods such as extrusion, roller coating, curtain coating and the like.

It has been found quite unexpectedly that the adhesive qualities of the bonding material are enhanced when a shape molded backing member 14 having the aforementioned smooth surface structure is employed. Without being bound to any theory, it is believed that the smooth surface structure of the backing member disclosed herein provides a suitably uniform bonding surface that permits a continuous cross-sectional bond throughout the surface region of the backing member 14 and the interior surface of the siding layer 12 with minimized quantities of adhesive, thereby achieving greater bonding area with superior bond strength while potentially reducing adhesive quantities employed. In contrast, backing members formed by wire cutting methods exhibit surfaces with large numbers of open cells. The uneven surface topography presents challenges in achieving uniform adhesive deposition. Generally thicker and possibly localized adhesive coatings are necessary to achieve a suitable bonding layer between the siding layer and the backing member. Without being bound to any theory, it is believed that shape molding process in which the polymeric material is expanded in a die mold produces a surface particularly suited to the application of adhesive material. The surface of the shape molded backing member is characterized by compressed closed cell polymeric material that provides a tough smooth surface to which the adhesive can be applied and adhered.

It is contemplated that the siding layer 12 can be composed of any suitable sheet or film stock material. Materials of choice typically will be materials resistant to extremes in the external environment over the life of the insulating siding panel 10. Non-limiting examples of environmental challenges include extremes in temperature, prolonged exposure to ultraviolet light and/or certain levels of impact and vibrational challenges due to wind and the like.

The siding layer 12 may be composed of any suitable polymeric, or cementious material. It is contemplated that the siding material will be one capable of providing suitable environmental resistance and durability. The material of choice may be suitable vinyl materials as well as materials such as fiber cement.

The material employed in the siding layer 14 may have sufficient thickness to maintain its shape and contour throughout the useful life of the insulated siding element 10 when the siding layer 12 is integrated with a suitable backing member 14. It is contemplated that the siding layer 12 can be suitably contoured to conform to the contours of the shape-molded backing member 14. While the correspondence between the respective contours can be exact, if desired or required, it is contemplated that the contours in the respective elements can vary depending upon the nature of the end product.

Suitable polymeric materials for use in the siding layer 12 can include, but are not limited to, thermoplastic and/or thermosetting materials of which various grades of vinyl are an example of but one suitable class. Other examples of suitable film or sheet stock material include various extruded ionmeric films, polyethylene based films and the like. It is contemplated that the siding layer can be formed of geometrically self-supporting materials. Alternately, it is contemplated that the siding layer 12 can be formed of materials that derive their support, at least in part, from the underlying shape-molded backing member 14.

While it is contemplated that the siding layer 12 can be self supporting, it is believed that the shape molded backing member 14 having the tough, smooth outer surface can provide sufficient support for the siding layer 12. Thus it is contemplated that the siding layer 12 can be prepared from a reduced thickness vinyl material such as materials below 0.04 inches. Alternately, the material may be a flexible polymeric film material that derives its shape and contour from the underlying shape molded backing member 14.

The degree to which a polymeric film or layer material is flexible and derives its support from the shape molded backing member 14 is determined, at least in part by the impact resistance requirements of the finished insulated siding elements 10. As used herein, the term "impact resistance" is taken to mean the ability of the siding layer to resist or withstand tearing or breakage due to impact of an object with the siding element. The shape molded backing member disclosed herein has been found, unexpectedly, to increase impact resistance of resulting siding layer by 3 times or greater. Thus the backing member configuration disclosed herein can permit reduction in the gauge of the siding layer to reduce costs without compromising performance and durability of the finished product.

One non-limiting example of suitable characteristics for domestic homes is that the insulated siding element 10 will have an impact resistance of at least 160 inch/pounds as measured by industry standard ASTM D4426.

The shape molded backing member 12 of insulated siding panel 10 also has a rear face having a smooth, tough surface. The rear face can be flat or have any contours desired or required to enhance performance of the insulated siding unit 10 during installation or in the field as installed. These include, but are not limited to, water management or drainage channels, offsets, customer identification or brand indicia, and the like. Water problems associated with poor water diffusion have been solved by new water management systems that can direct water down and out of the exterior wall.

The shape molded backing member 12 disclosed herein may have an aspect ratio of height to length of three or greater. Additionally it is contemplated that the ratio backing member length to thickness greater than 100 to 1.

It is contemplated that the shape molded backing member can have a length of between 36 inches and 240 inches and will typically have lengths of 144 to 240 inches, as desired or required. The resulting element and/or associated insulated siding panel 10 will be essentially straight and free from camber and bowing.

The backing member 14 can have a suitable width. Non-limiting examples of suitable widths would be between 7 and 48 inches, with typical widths between 8 and 36 inches in various applications.

The shape molded backing member 14 can have a suitable thickness such that the resulting unit 10 has a thickness between 250 thousandths of an inch and 4 inches.

Figure 8:
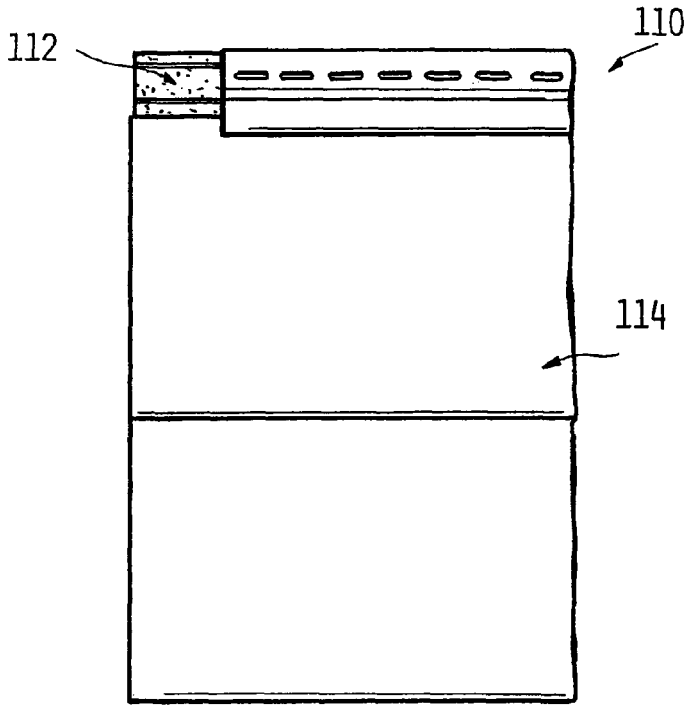
FIG. 8 is a front elevational view of a portion of a shape molded foam insulated siding backer panel.
Figure 9:
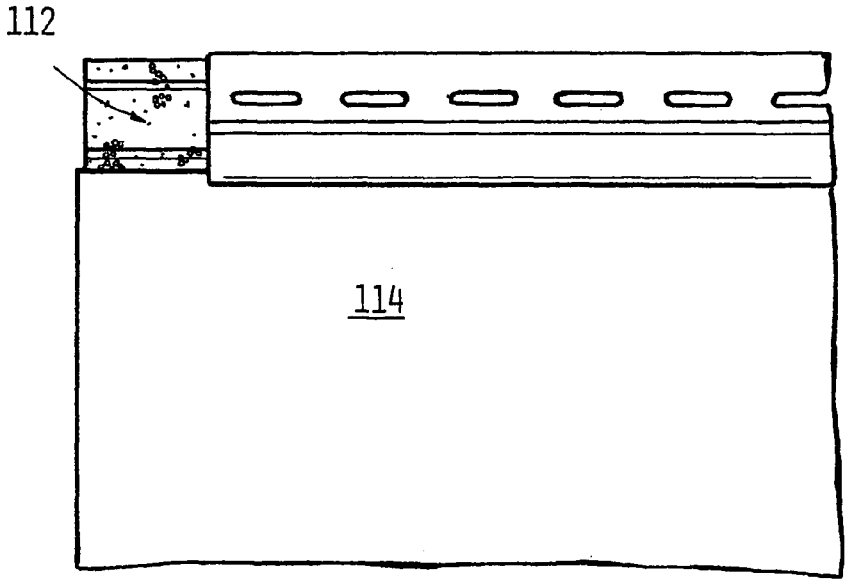
FIG. 9 is a detail front elevational view of a portion of the panel of FIG. 8.

Referring now to FIGS. 8-25*b*, the siding layer 114 overlies a suitable backing member 112, illustrated in the cutaway portion in FIG. 8. It is contemplated that the backing member can be joined to the siding layer 114 in any suitable manner such as by interposition of a suitable adhesive at any time prior to installation on a suitable wall.

Figure 10:
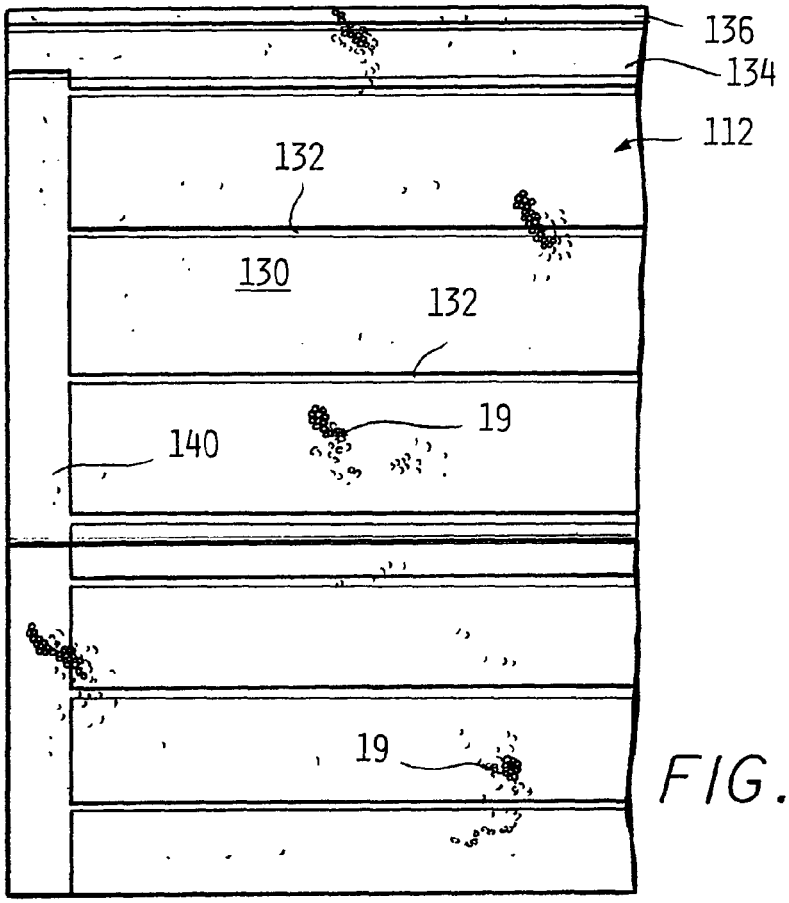
FIG. 10 is a front elevational view of the backer member of the composite insulated siding panel of FIG. 8 with the siding layer removed.
Figure 11:
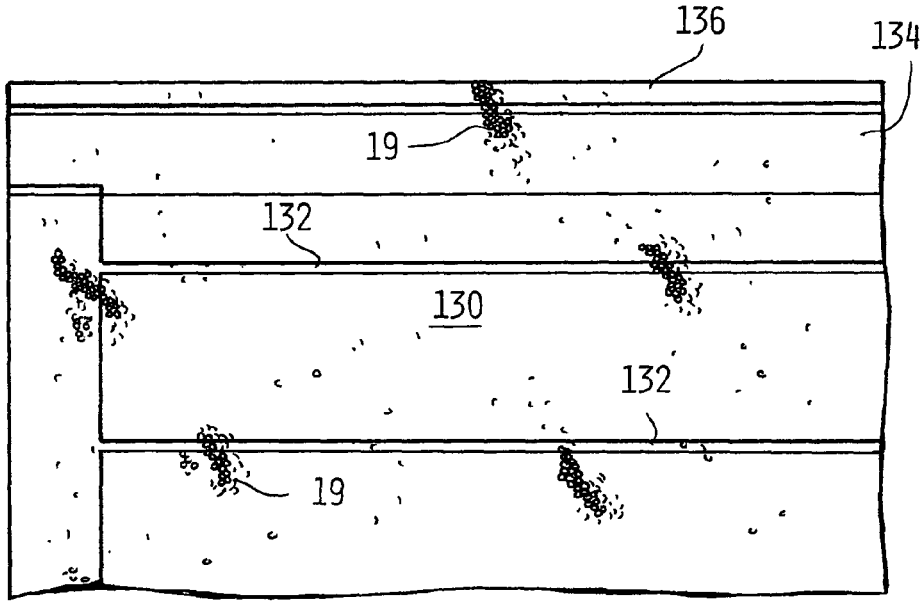
FIG. 11 is a detail front elevational of the upper portion of the backer member of FIG. 10.
Figure 12:
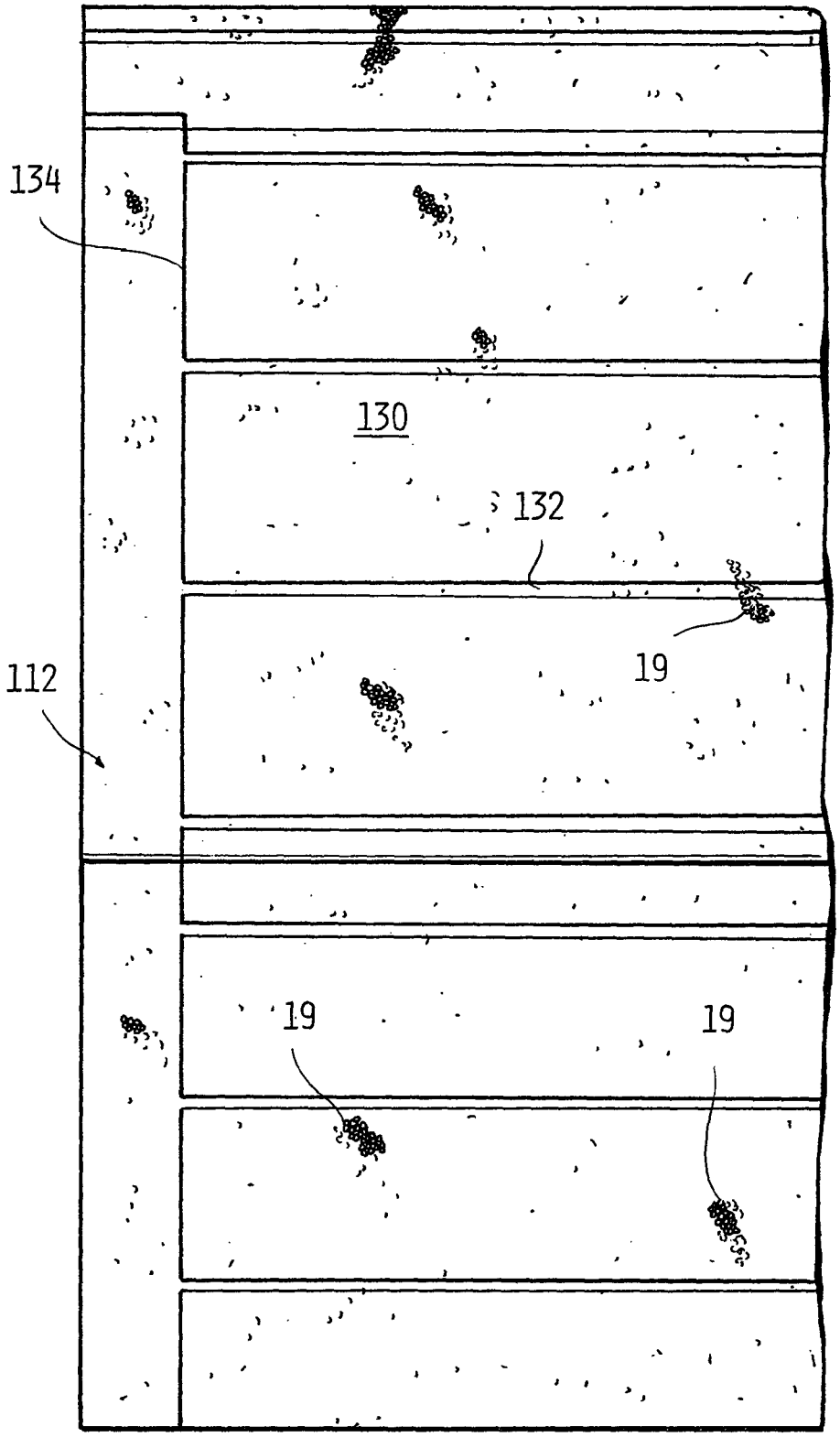
FIG. 12 is a detail elevational view of the side portion of the backer member of FIG. 10.

A portion of the shape molded backing member is depicted in FIG. 10. As depicted, the shape molded backing member 112 has a front face 130 that is composed of an outer surface having a tough smooth skin containing closed cell cellular polymeric material. The front face 130 can also include various geometric configurations as desired or required. In the backing member 112 as illustrated, the upper face includes a plurality of parallel grooves 132 as well as a transverse band 134 at the upper edge immediately below an outwardly projecting edge136.

The shape molded backing member 112 as depicted in FIG. 10 also includes a suitable shape molded detent 140 extending along one side edge of the backing member 112. The detent 140 is configured to follow general surface and geometric contours of the member 112.

Figure 13:
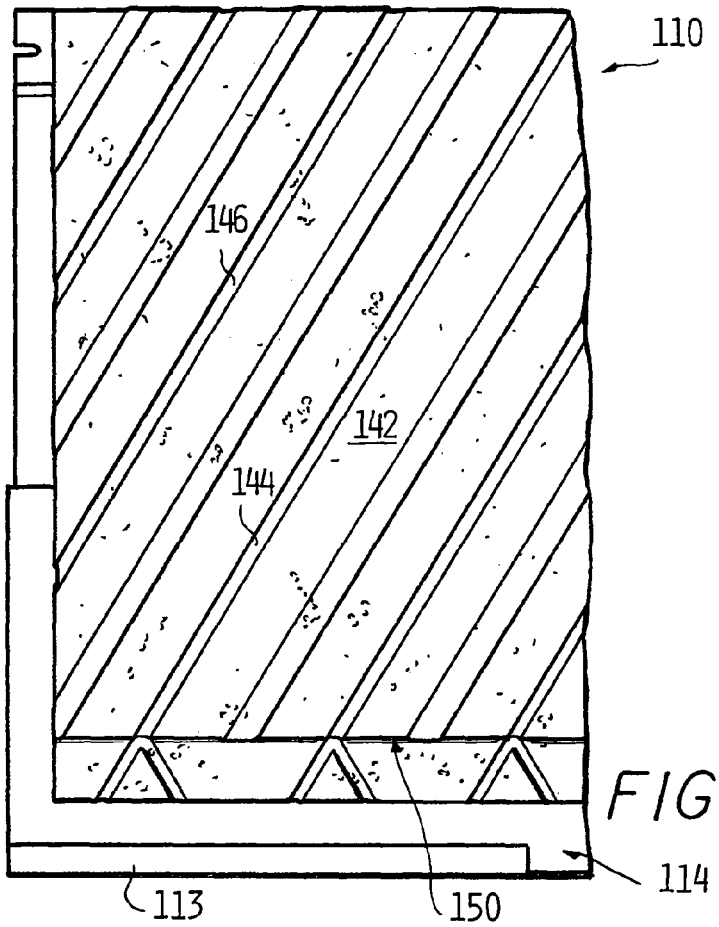
FIG. 13 is an elevational view of a back portion of the backer member of FIG. 10.
Figure 14:
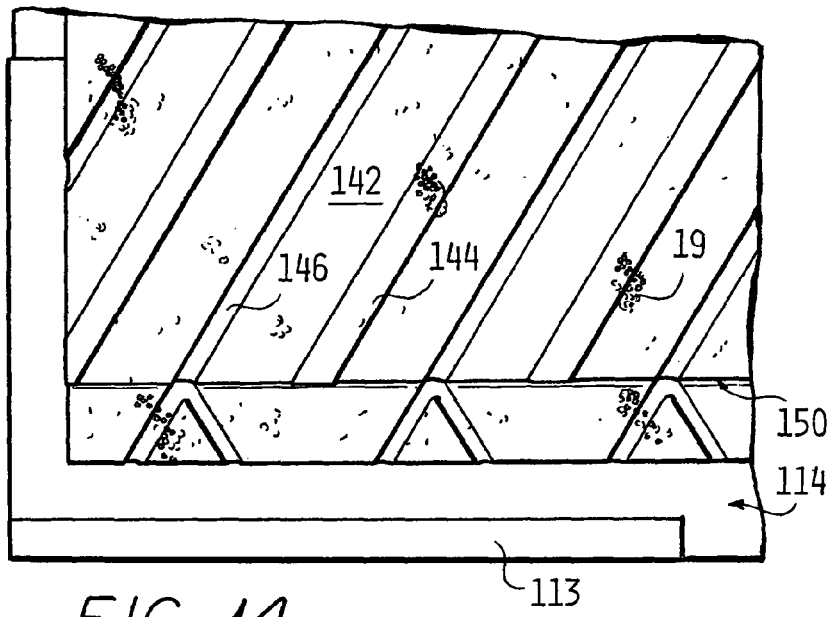
FIG. 14 is a detail elevational view of the bottom portion of the insulated siding panel of FIG. 13.

The rear side of the insulated siding panel 110 is depicted in FIGS. 13 and 14. The rear face 142 can have any suitable geometric configuration. As depicted in FIGS. 13 and 14, the backing member 112 includes a plurality of diagonal channels extending along the face of the backing member 112. It is contemplated that the rear face will have an outer face having a tough smooth skin formed from closed cell polymeric material. As depicted, the diagonal grooves alternate between a wider channel 144 and a narrower channel 146. It is also contemplated that the depth of the channels and/or elevation of planar regions positioned between the grooves can vary from groove to groove as desired or required to achieve necessary standoff between the insulated siding panel and the associated wall.

The rear face 142 can also include a suitable indent 150 located at the lower edge of the shape molded backing member, The indent 150 will typically be shape-molded and will have a thickness suitable to position and receive a mating insulated siding panel in abutting relationship therewith.

In the insulated siding panel 110 as depicted in the drawing figures, it is contemplated that the siding layer projects downward beyond the lower edge of the shape molded backing member 112. The downwardly projecting siding layer can have an inwardly curves edge 113. The curved ridge can extend the length of the insulated siding panel or can include a suitable cutaway at one edge to facilitate assembly and/or installation. It is also contemplated that the shape-molded backing member projects outward beyond one side edge of the shape molded backing member 112. It is contemplated that the sideward projection will be between 1 half inch and 3 inches.

Figure 15:
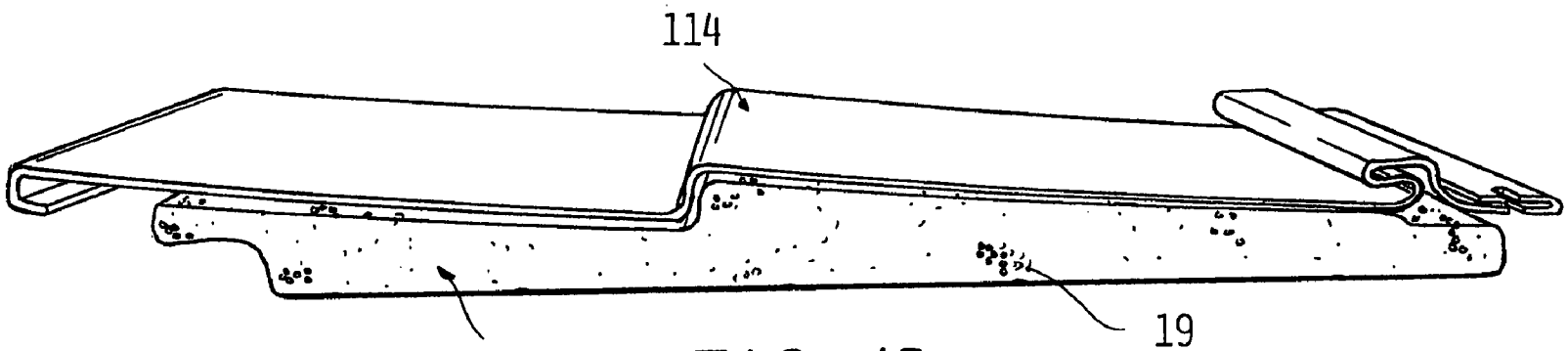
FIG. 15 is a view of a cross-sectional cut through the backer panel portion of FIG. 8.
Figure 16:
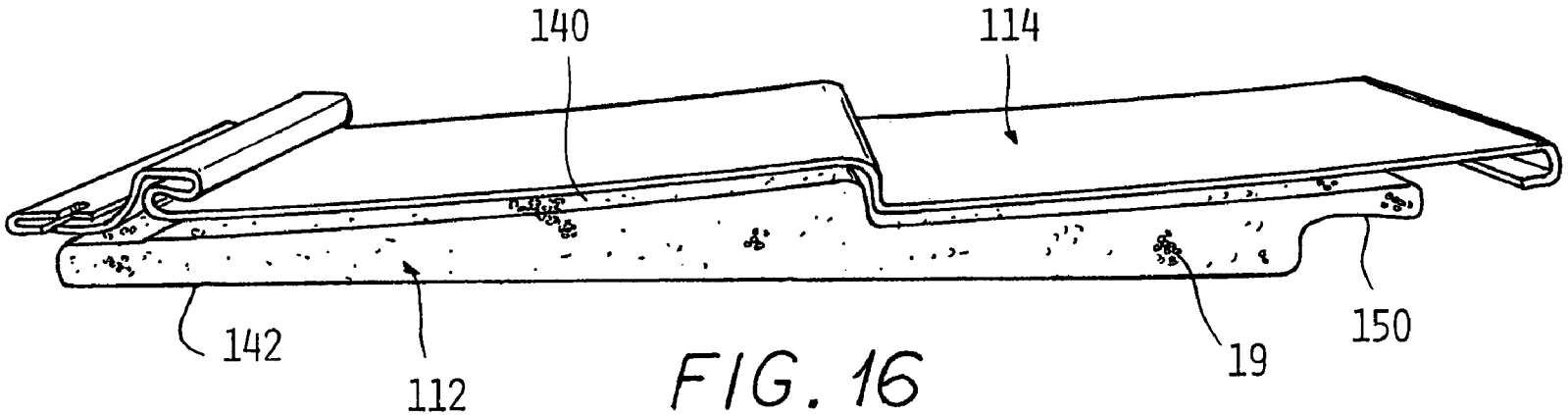
FIG. 16 is a side view of the insulated siding panel of FIG. 8.

FIGS. 15 and 16 are side views taken from various sides of the insulated siding member 110. The view in FIG. 15 is a cross sectional cut through a central portion of the insulated siding member 110. As can be seen in that figure, the indent 150 will have a thickness that approximated the thickness of the inward curve, with the thickness of the backing member varying to accommodate and approximate the contour of the various slats in the insulated siding member.

Figure 17:
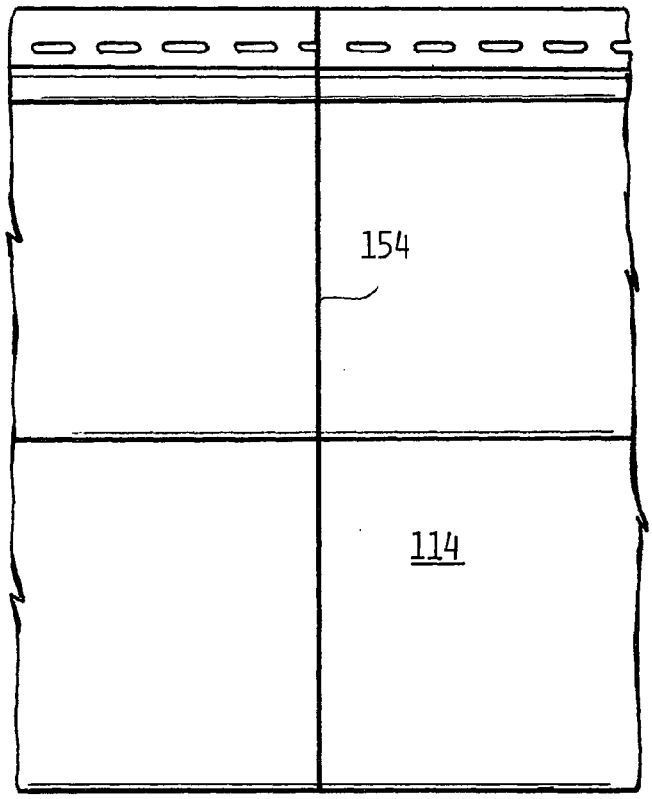
FIG. 17 is a front elevational view of portions of two abutting insulated siding panels.
Figure 18:
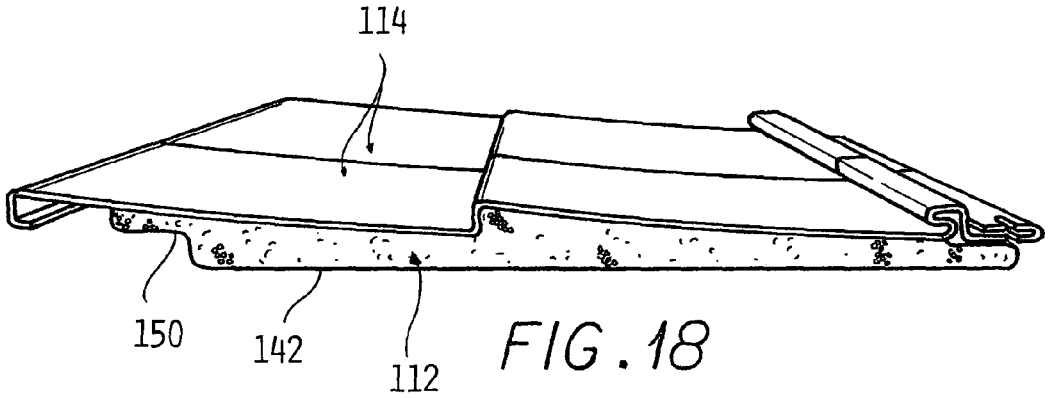
FIG. 18 is a side view of the abutting side panels in FIG. 17.

The insulated siding panels 110 are configured to mate in side-to-side abutting relationship as depicted in the FIGS. 17 through 21. An insulated siding panel is configures so that the projection portion of one insulated siding panel 110 is received into that detent 128 formed in a mating insulated siding panel to form a continuous siding surface as depicted in FIG. 17. It can be appreciated that the seam 154 can be one that is snugly positioned relative to one another so that the resulting siding assembly is resistant to cupping, separation and wind permeation.

Figure 19:
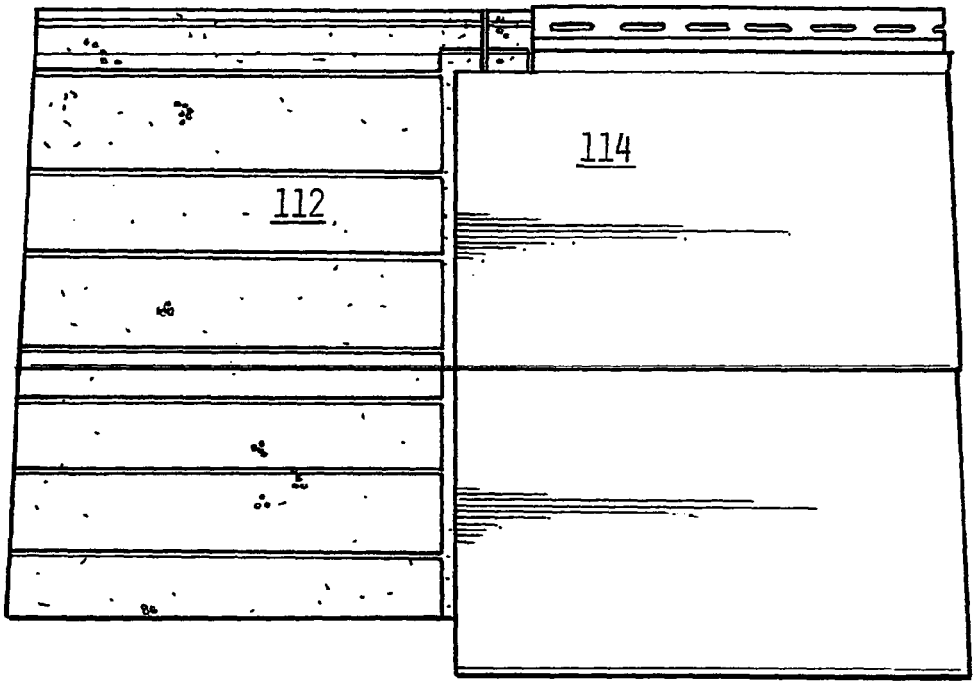
FIG. 19 is an elevational view of the abutting panels of FIG. 17 with one siding layer removed.
Figure 20:
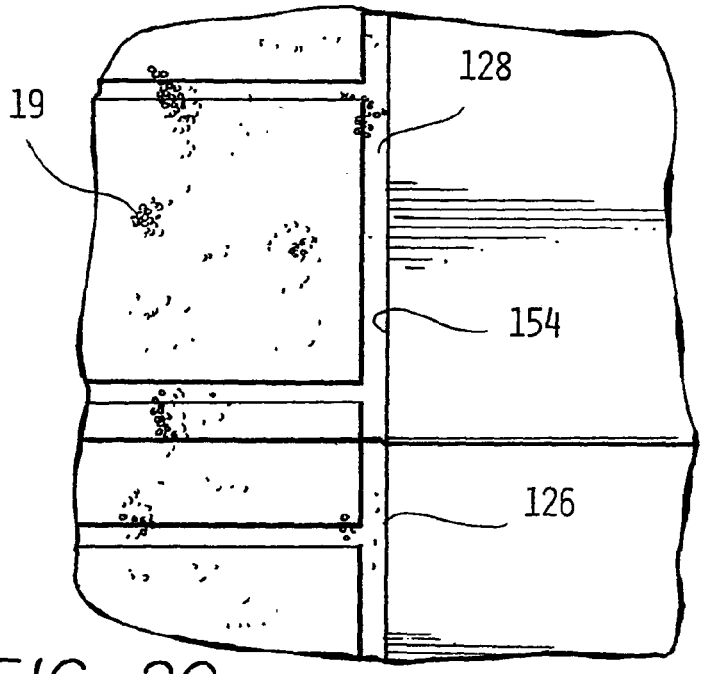
FIG. 20 is a detail elevational view of FIG. 19 taken at the central portion.
Figure 21:
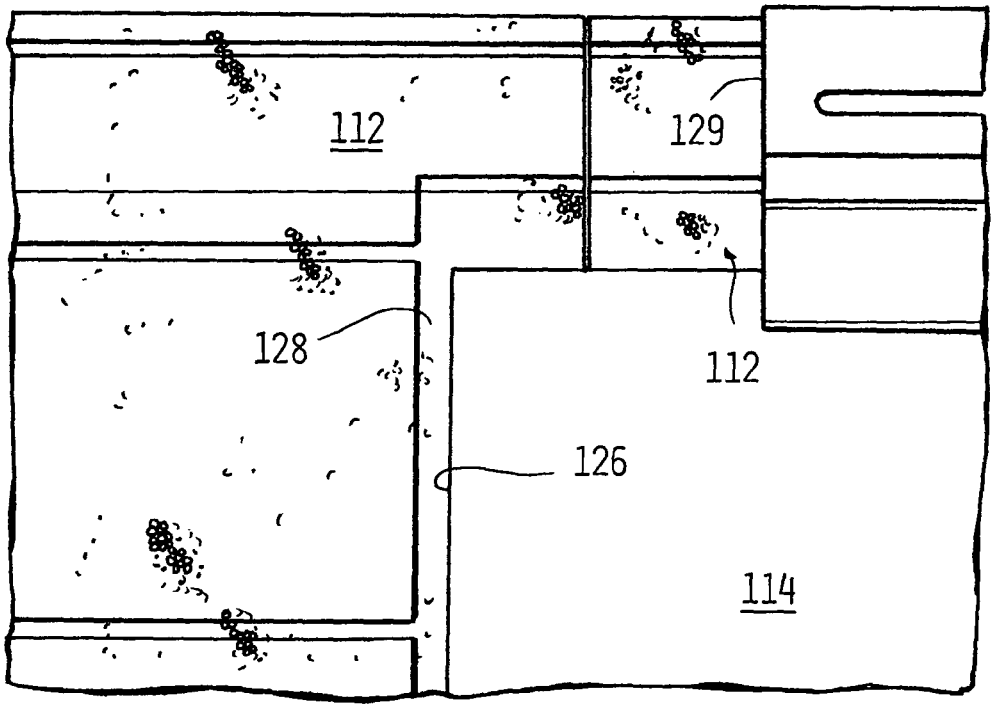
FIG. 21 is a detail elevational view of FIG. 19 taken at the top central portion.

FIG. 19 is presented with the siding layer of one insulated siding panel removed to demonstrate how the projecting edge of the abutting insulated siding member is received in the mating detent. As depicted in FIG. 20, the projecting siding edge 126 is received and positioned neatly relative to the associated detent 128. The upper edge configuration 129 is depicted in FIG. 21.

Figure 22:
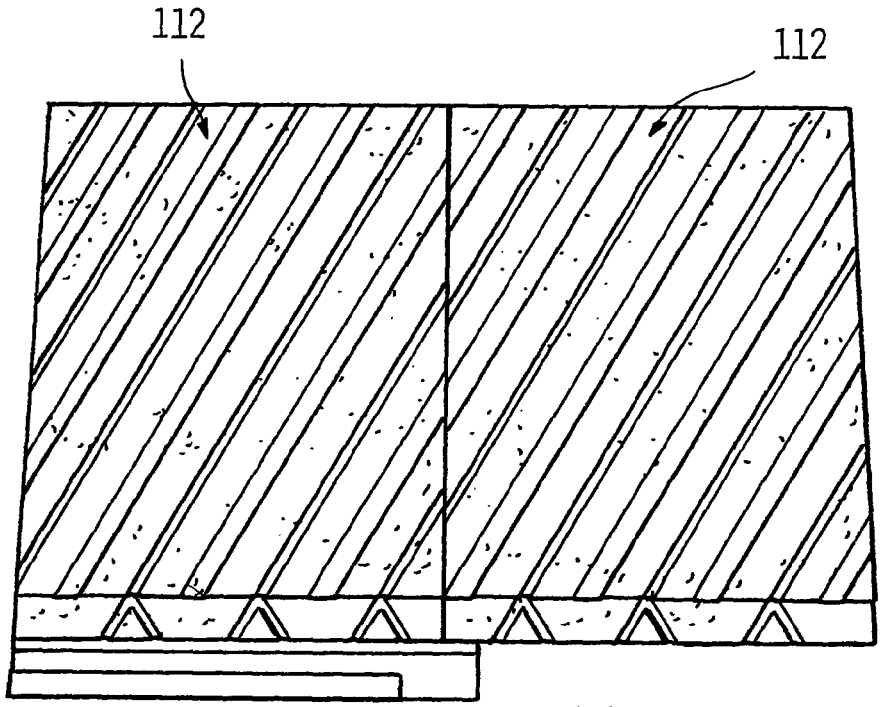
FIG. 22 is an elevational view of the back portion of the abutting panels of FIG. 19.
Figure 23:
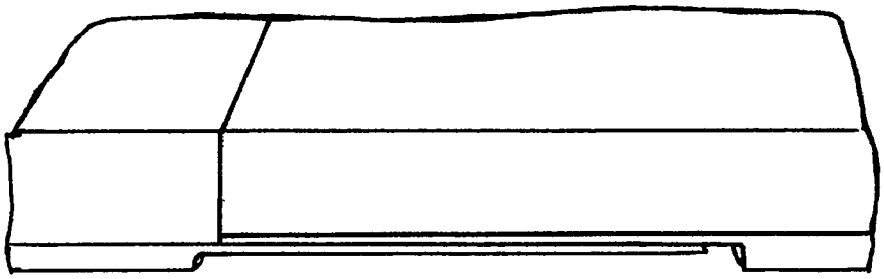
FIG. 23 is an end view of the abutting panels of FIG. 19 showing the bottom rear portion thereof.

Rear panel configurations of abutting insulated siding panel members are depicted in FIGS. 22 and 23. Where desired or required, the rear panel configurations and be positioned such that the rear configurations correspond or cooperate as desired or required. It is contemplated that the lower edge of the respective siding layers can be configured to receive one another in overlapping relationship as depicted in FIG. 23.

Figure 24:
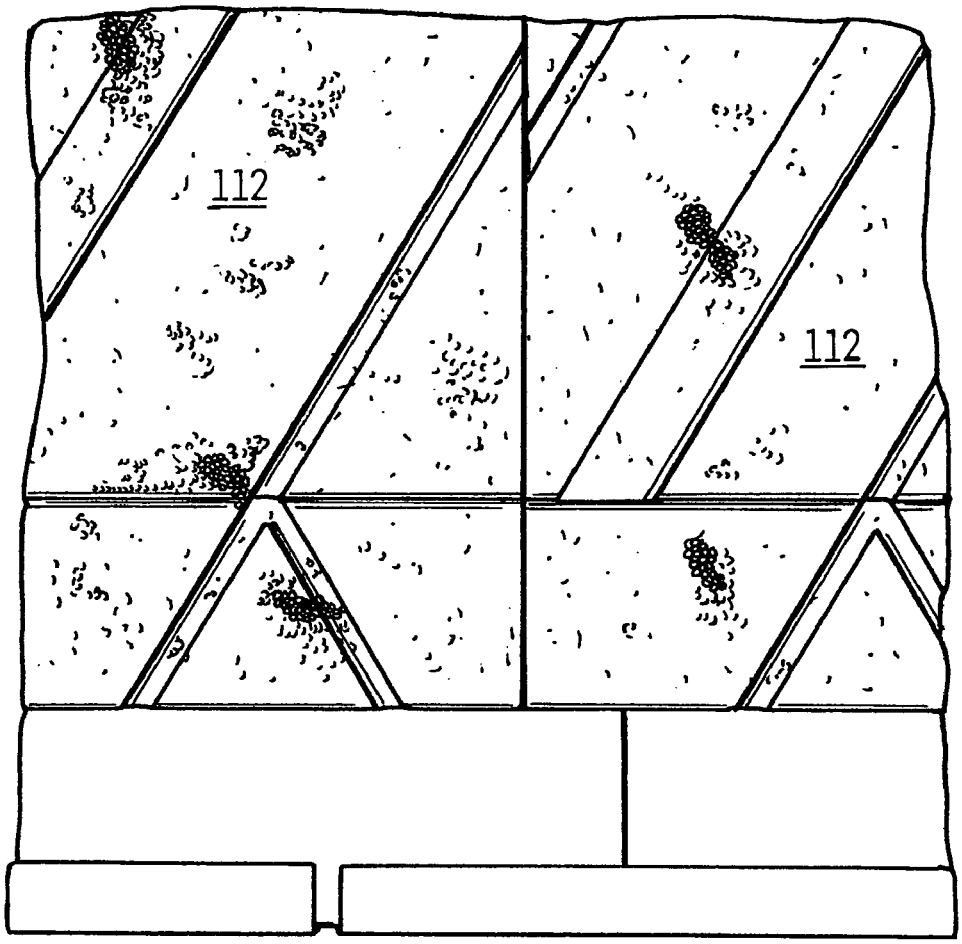
FIG. 24 is an elevational view showing a bottom detail of the two abutting insulated siding panels of FIG. 17.
Figure 25A:
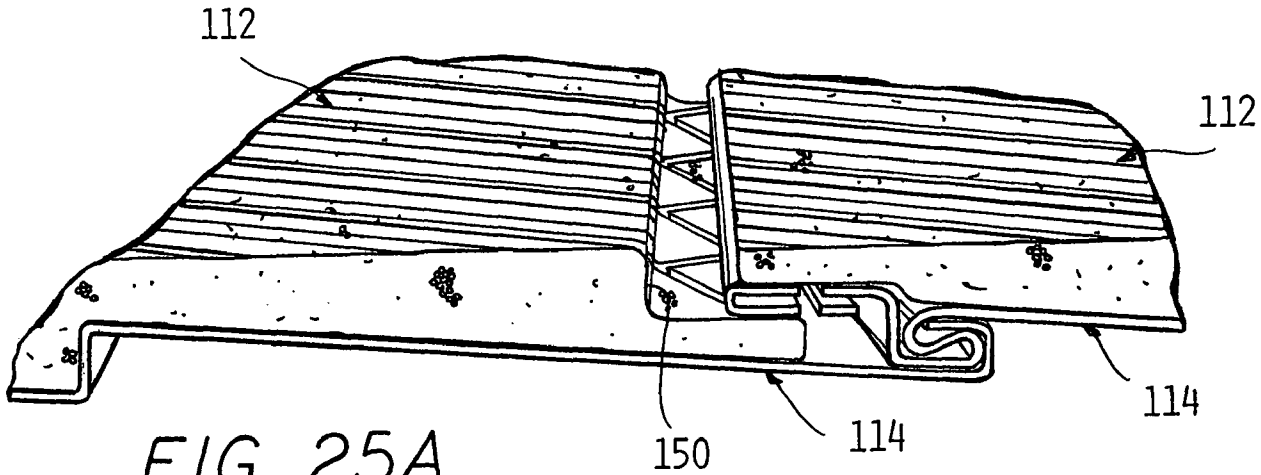
FIGS. 25A and 25B are side detail views of two panels abutting top to bottom with one another.
Figure 25B:
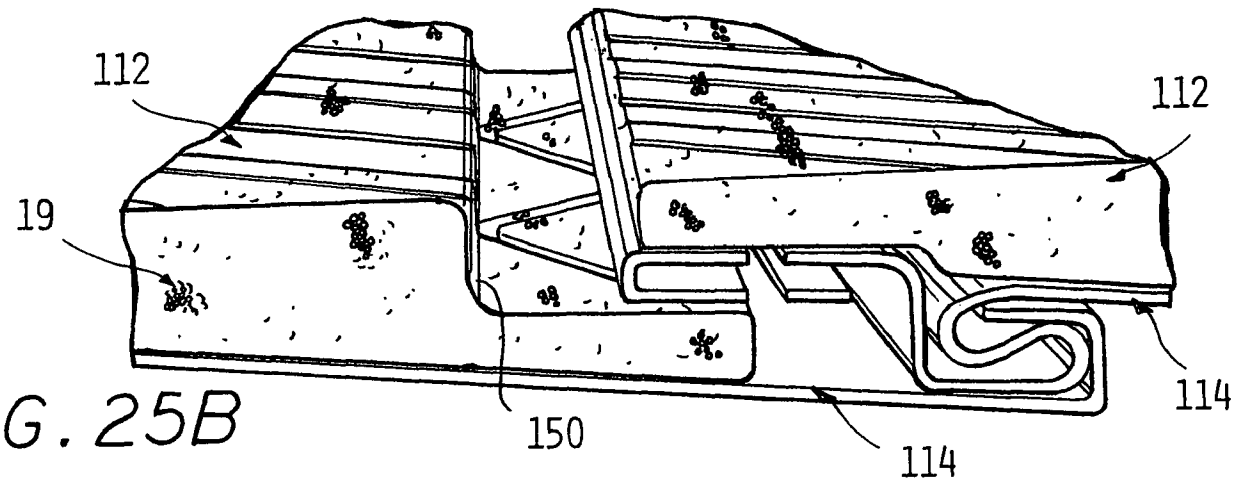

Insulated siding panels can be installed in abutting top-to bottom relationship as depicted in FIGS. 24 and 25A, B where the lip formed proximate to the top of one siding layer engages the lip configured in the lower edge of an associated siding panel. The upper most edge of one insulated siding panel projects upward into the detent 150 formed in the abutting insulated siding panel member.

In various alternate embodiments it is contemplated that the shape molded backing member may be prepared in lengths greater than four feet, with lengths as great as 20 feet being contemplated. The shape molded backing member 112 can be attached to the siding layer 114 at any time prior to installation on the wall. It is contemplated that, where desired or required, the siding layer can be attached to the backing member at the factory or in the field.

While the invention has been described in connection with what is presently considered to be the most practical and preferred embodiments, it is understood that the invention is not limited to the disclosed embodiments, but is intended to cover various modifications and equivalent arrangements included within the spirit and scope of the claims. The claims are to be accorded the broadest possible interpretation so as to encompass all such modifications and equivalent structures and instructions as permitted under the law.

What is claimed is:

1. A panel for mounting on a wall comprising:

a shape-molded backing member composed of closed cell expanded foam having a rear face and an opposed front face having at least one shape-molded contour defined therein the shape-molded backing member having an outer surface composed of a tough smooth skin and having a top edge, a bottom edge, a first side edge and a second side edge; and a vinyl siding member in overlying relationship with the front face of the shape-molded backing member and having an overhang extending beyond at least one of the first and second side edges;

wherein the front face comprises a vertical detent along at least one of the first and second side edges of the front face, the vertical detent configured to receive the overhang of the vinyl siding member of an adjacent panel member;

wherein the vertical detent runs from the bottom edge of the backing member to a distance short of the top edge of the backing member, and wherein the overhang of the vinyl siding member runs from a bottom edge of the vinyl siding member to a distance short of the top edge of the vinyl siding member.

2. The panel member of claim 1, wherein the shape-molded backing member has a thickness between ¼ inch and 4 inches.

3. The panel member of claim 1, wherein the at least one shape-molded contour comprises at least one shoulder, a planar region extending from a depressed edge of the at least one shoulder, and an outwardly extending region extending from the planar region opposite the shoulder, the shape-molded contour having the tough, smooth skin.

4. The panel member of claim 1, wherein the vinyl siding member has a thickness between 0.020 and 0.036 inches inclusive.

5. The panel member of claim 1, further comprising an adhesive layer interposed between at least a portion of the front face of the backing member and the vinyl siding member, wherein the adhesive is continuously flexible, non-latex adhesive.

6. The panel member of claim 1, wherein the shape-molded backing member comprises a plurality of regions within the backing member, each region having a different density of closed cell expanded foam, the region configured to provide structural integrity and support to a resulting siding panel through different densities.

7. The panel member of claim 1, wherein the shape-molded backing member further includes opposing side faces contiguously positioned between the front and rear faces, at least one of the side faces having the tough smooth skin.

8. The panel member of claim 1, wherein the front face of the shape-molded backing member proximate the top edge includes at least one outwardly projecting lip member comprised of shape-molded foam and extending away from the wall beyond an upper edge of the vinyl siding member.

9. The panel member of claim 1, wherein the shape-molded backing member further includes at least one upper face and one lower face contiguously positioned between the front and rear faces, one or both of the upper face and lower face having a tough smooth surface.

10. The panel member of claim 8, wherein the rear face comprises a lateral relief spanning the width of the rear surface along the bottom edge of the rear face of the backing member, the lateral relief configured to be in overlaying relationship with the outwardly projecting lip member of an adjacent shape molded backing member.

11. The panel member of claim 1, wherein the rear face of the shape-molded backing member includes at least one lateral relief defined proximate the bottom edge along the width, the lateral relief configured to receive a projecting lip of an adjacent vinyl siding member.

12. The panel member of claim 1, wherein the rear face of the shape-molded backing member includes a water management means for directing water down and out of the wall.

13. The panel member of claim 1, wherein the at least one shape-molded contour comprises a centrally positioned ridge spanning a width of the backing member.

14. The panel member of claim 1, wherein the front face comprises spaced parallel grooves.

15. The panel member of claim 7, wherein the opposing side faces are planar and configured to abut a side face of an adjacent shape-molded backing member between the overhang and the wall.

16. The panel member of claim 12, wherein the water management means comprises diagonal grooves alternating between a wide channel and a narrow channel across the rear face.

17. A panel for mounting on a wall comprising:

a backing member having a front face, a rear face, a first side face, and a second side face; and a siding member overlaying and attached to the front face of the backing member, the siding member having an overhang extending beyond the the first side face;

wherein the backing member has a length between 48 and 240 inches and a thickness between 0.25 and 4 inches and is composed of closed cell expanded polystyrene foam, and wherein the opposing side faces are planar and figured to abut a side face of an adjacent backing member between the overhang and the wall; and wherein the front face of the backing member comprises a vertical detent along the second side face, the vertical detent configured to receive the overhang of the siding member of an adjacent panel, the vertical detent running from a bottom edge of the backing member to a distance short of a top edge of the backing member, and wherein the overhang of the siding member runs from a bottom edge of the siding member to a top edge of the vinyl siding member.

* * * * *